US006425637B1

(12) United States Patent
Peterson

(10) Patent No.: US 6,425,637 B1
(45) Date of Patent: Jul. 30, 2002

(54) CUSHION CONSTRUCTION FOR FURNITURE

(75) Inventor: Gordon J. Peterson, Rockford, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/294,665

(22) Filed: Apr. 19, 1999

(51) Int. Cl.[7] ..... A47C 7/26

(52) U.S. Cl. ..... 297/452.3; 297/452.31; 297/452.48; 297/452.43; 297/452.56

(58) Field of Search ..... 297/452.46, 452.47, 297/180.1, 180.14, 452.31, 452.32, 452.33, 180.11, 180.13, 452.48, 452.55, 452.56, 452.42, 452.43

(56) References Cited

U.S. PATENT DOCUMENTS 4,556,254 A * 12/1985 Roberts ..... 297/452.3 X
4,946,220 A * 8/1990 Wyon et al. ..... 297/180.14
5,169,580 A 12/1992 Marcus
5,294,392 A 3/1994 Marcus
5,298,321 A 3/1994 Isoda et al.
5,399,423 A 3/1995 McCullough et al.
5,407,739 A 4/1995 McCullough et al.
5,489,351 A 2/1996 Yoshida et al.
5,492,662 A 2/1996 Kargol et al.
5,494,627 A 2/1996 Kargol et al.
5,505,815 A 4/1996 Yoshida et al.
5,551,755 A 9/1996 Lindberg
5,614,296 A 3/1997 Travelute et al.
5,639,543 A 6/1997 Isoda et al.
6,003,950 A * 12/1999 Larsson ..... 297/180.14 X
6,109,688 A * 8/2000 Wurz et al. ..... 297/180.14
6,131,221 A * 10/2000 Yang ..... 297/452.48

* cited by examiner

*Primary Examiner*—Anthony D. Barfield
(74) *Attorney, Agent, or Firm*—Price, Heneveld, Cooper & Litton

(57) ABSTRACT

A chair includes a base, a back, and a seat with at least one of the back and seat including a cushion made from a non-woven fibrous material. A method includes steps of cutting a blank from a sheet of non-woven fibrous material, forming the blank into a preformed cushion shaped to support one of a user's back or buttock and thighs, and attaching the preformed cushion to a support panel to provide a stiffened cushion assembly and covering the cushion assembly to provide an aesthetically covered chair component.

23 Claims, 8 Drawing Sheets

CUSHION CONSTRUCTION FOR FURNITURE

BACKGROUND OF THE INVENTION

The present invention relates to cushion constructions for furniture having improved cushioning properties.

Chairs having upholstery covered cushions on their seat and backs are known. The cushions provide a cushioning effect that conforms at least somewhat to a seated user's body to provide increased comfort. A common cushion in chairs is a polyurethane open-celled foam cushion that is preformed to an initial shape. For example, U.S. Pat. No. 4,718,153, to Armitage et al., issued Jan. 12, 1998, entitled *Cushion Manufacturing Process*, discloses one such cushion manufacturing process utilizing a polyurethane foam. A problem is that the polyurethane will degrade over time, leading to breakdown of the polyurethane foam that generates dust and a degradation of cushioning properties. The dust and breakdown potentially adds to environment dust in the building where the chair is located. Also, the breakdown and loss of material results in changes to the cushioning support provided by the cushion. Polyurethane foam cushions also suffer from other disadvantages. Polyurethane foam is not recyclable, leading to increased landfill costs when scrap is generated. Further, the polyurethane foam typically has a pinched-off edge or weld line of higher density material running around its perimeter. The higher density material can cause quality problems, both in terms of poor appearance due to its roughness, stiffness, and protruding nature, and also in terms of an unattractive bumpy feel when a person sits on or feels the fabric covering the higher density material. Still another problem is caused when a seated user sweats against a polyurethane foam cushion, because the polyurethane foam cushions are sometimes not able to wick away the sweat (or at least not fast enough), depending on the foam and the volume of sweat.

Accordingly, an improved cushion construction for furniture is desired that solve the aforementioned problems and have the aforementioned advantages.

SUMMARY OF THE INVENTION

In one aspect of the present invention, a chair includes a base, a back, and a seat. At least one of the back and seat include a support panel, a cushion thereon made from a non-woven fibrous mat, and upholstery covering at least a side of the cushion. In a narrower form, the non-woven fibrous mat comprises polyethylene terephathalate (PET) that is recyclable, with at least some fibers being from reground pop bottles and similar containers.

In another aspect of the present invention, a chair component manufactured for use in a chair includes a flexible support panel having a support surface shaped to support one of a seated user's back or a seated user's buttocks and thighs. A relatively thin cushion made from a non-woven fibrous mat of polymeric strands covers the support surface of the support panel, and upholstery covers the cushion. In a narrower form, the upholstery is wrapped around edges of the support panel and secured to a reverse side of the support panel.

In another aspect of the present invention, a method includes steps of cutting a blank from a sheet of non-woven fibrous material, forming the blank into a preformed cushion shaped to support one of a user's back or buttock and thighs. In a narrower form, the method includes a step of attaching the preformed cushion to a support panel to provide a stiffened cushion assembly.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 2:
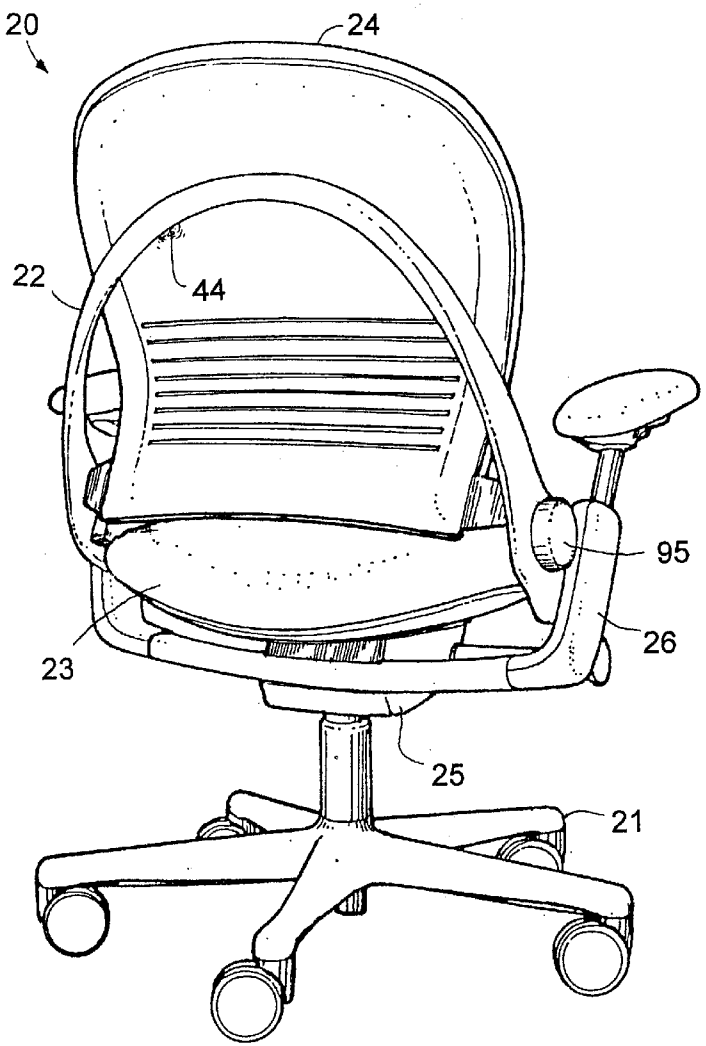
FIGS. 1 and 2 are front and rear perspective views of a chair embodying the present inventions.
Figure 1:
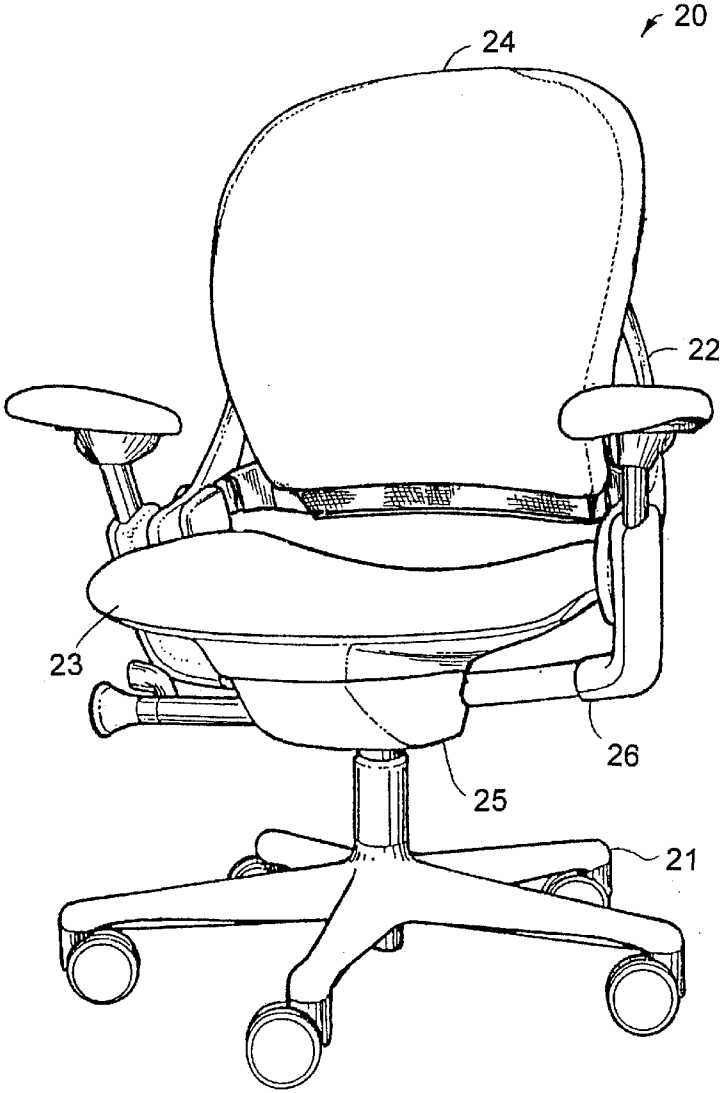
Figure 8:
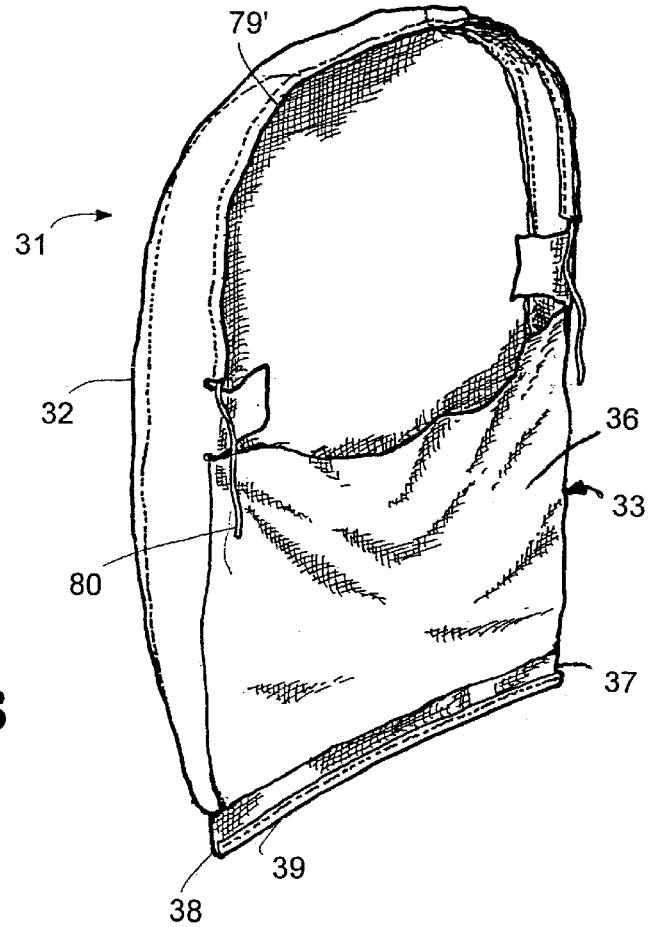
FIG. 8 is a perspective view of the cover assembly shown in FIG. 3.

A chair 20 (FIGS. 1 and 2) embodying the present invention includes a base 21, a back upright or arch-shaped back frame 22, a seat 23, and a back construction 24. The base 21 includes a control housing 25, with fixed side support structures 26 extending laterally and upwardly from the control housing 25. The back upright 22 is movable between an upright position and a reclined position. The back construction 24 (FIG. 3) includes a back support shell 27 (also referred to as a "back support") attached to the back upright 22 (FIG. 4), and further includes a cushion assembly 28 (FIG. 3) attached to the back support shell 27 with quick-attach hooking top connection 29 and a "zip-lock" type bottom connection 30. The cushion assembly 28 includes a cover assembly 31 (FIG. 8) having an upholstery front panel 32 and a rear panel 33 forming a sock that can be inverted and "pulled" upwardly onto a cushion 35 and cushion stiffener 34 as the cover assembly 31 is inverted. The rear panel 33 includes a first sheet/fabric section 36 having a one-directional stretch in a vertical direction, and further includes a lower second fabric section 37 having a high-stretch property. The second section 37 hangs downwardly from the front panel 32 and has a strip of stiff material 38 sewn along its lower edge to form the stiffened edge flange 39 noted below, which stiffened edge flange 39 forms part of the bottom connection 30. The stretchable second section 37, in combination with the other structure of top and bottom connections 29 and 30, allow for quick assembly, yet provide for a tensioned cover assembly 31 on the back construction 24 that tends to remain flat and unwrinkled, even with considerable flexure of the back construction 24 in the lumbar region of the back construction 24.

The present description of chair 20 is believed to be sufficient for an understanding of the present combination. Nonetheless, it is noted that a more detailed description of the chair 20 can be found in U.S. Pat. No. 5,871,258, issued Feb. 16, 1999, entitled *Chair with Novel Seat Construction*, and also in U.S. patent application Ser. No. 08/957,473, filed Oct. 24, 1997, entitled *Chair Including Novel Back Construction*, the entire contents of both of which are incorporated herein in their entirety by reference. It is to be understood that a scope of the present invention includes using the present attachment and construction methods in combination with different office chairs, but also in many other chairs and seating where upholstery covering is desired, such as in couches, lounge seating, mass transit seating, automotive or bus seating, and stadium seating, or also in other upholstery-covered furniture, such as padded desking furniture and the like, and also in non-furniture situations where upholstery or sheeting must be attached to a flexible or bendable component in a wrinkle-free manner.

Figure 3:
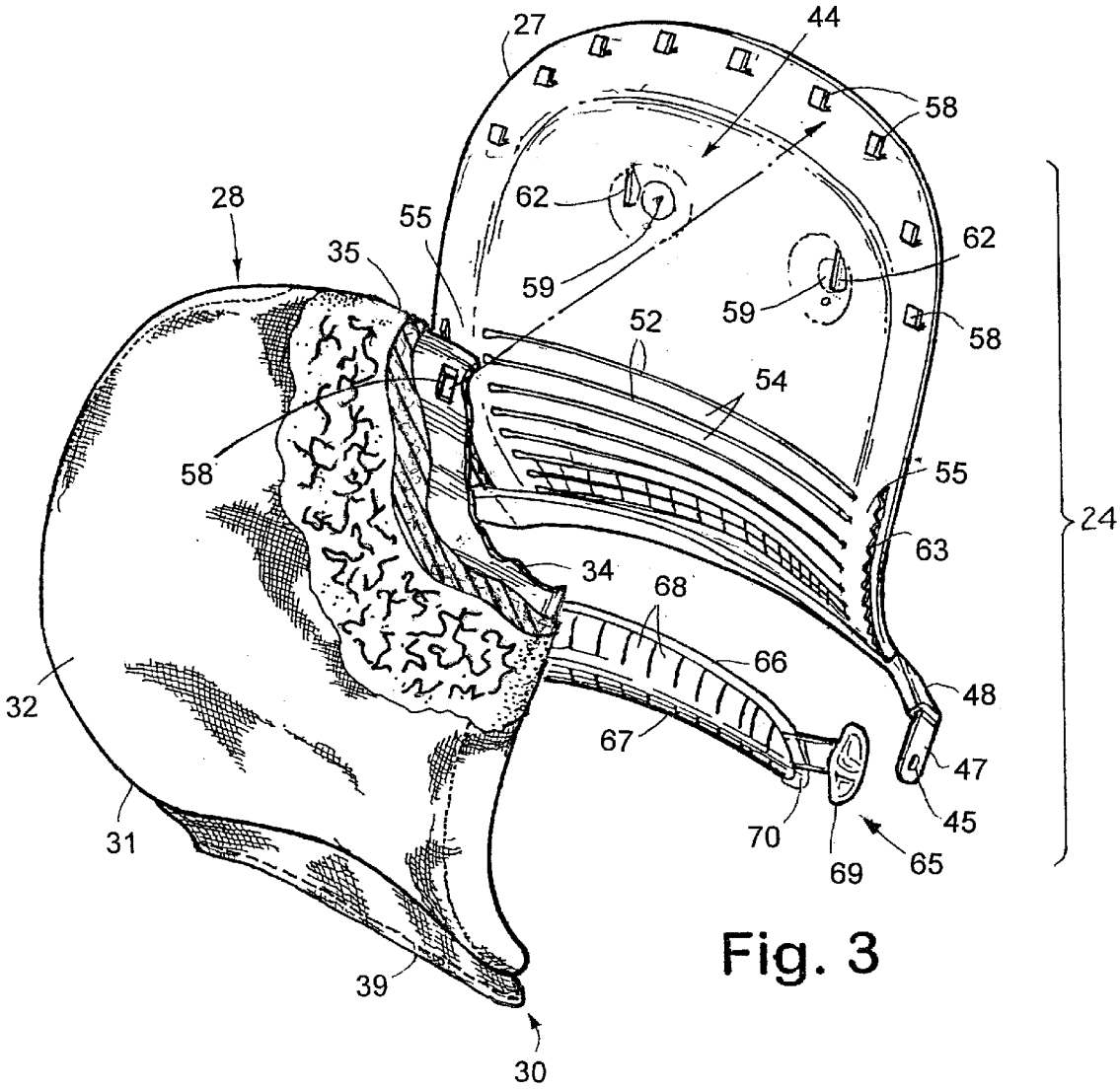
FIG. 3 is an exploded front perspective view of the back construction shown in FIG. 1.
Figure 4:
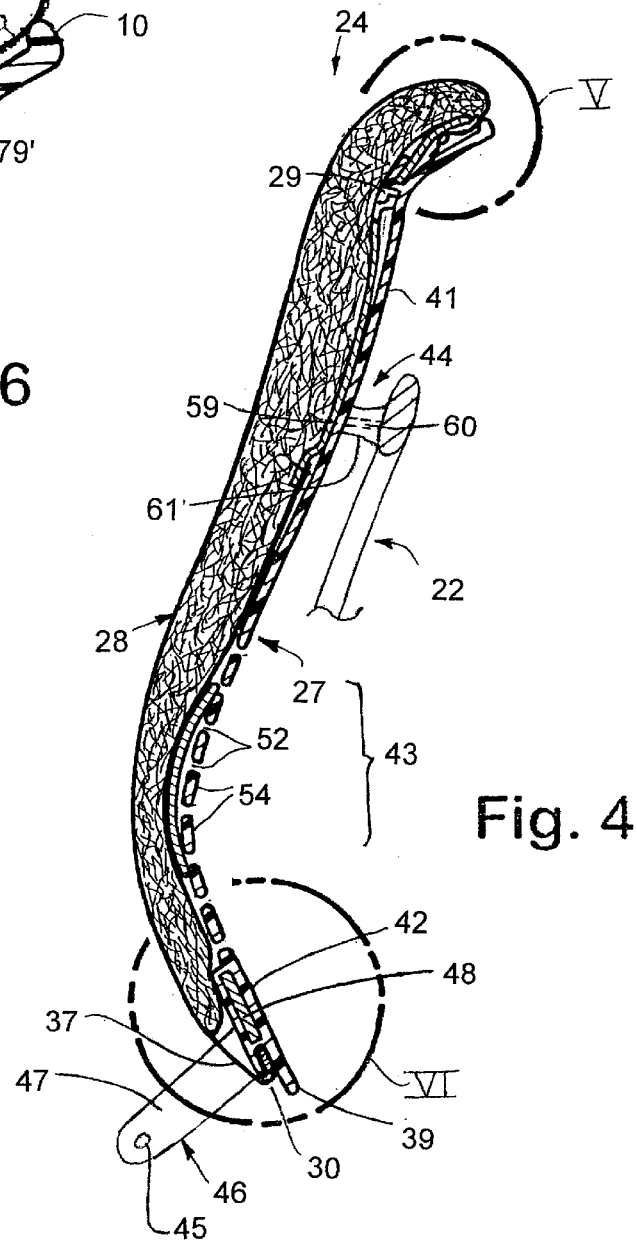
FIG. 4 is a vertical cross-sectional view taken through a center of the back construction showing in FIG. 1.

The back support shell 27 (FIG. 4) comprises a sheet of polypropylene material or similar engineering-type stiff structural material, and includes relatively stiff thoracic and pelvic sections 41 and 42 connected by a flexible lumbar section 43. The back support shell 27 is relatively stiff in a plane defined by the sheet, but is flexible in the lumbar section 43 in a direction perpendicular to the sheet. The thoracic and pelvic sections 41 and 42 are attached to the back frame 22 at top and bottom pivot locations 44 and 45, and the lumbar section 43 protrudes forwardly from the thoracic and pelvic sections 41 and 42. A belt bracket 46 extends parallel a lower edge of the pelvic section 42, and includes forwardly extending side flanges 47 each having a hole defining the bottom pivot location 45. The belt bracket 46 is encapsulated in an enlarged section 48 that extends along the lower edge of the pelvic section 42, and forms a horizontal recess 49 defined between a longer rear lip 50 and a shorter front lip 51. Slots 52 extend horizontally across a center area of the lumbar section 44 to form horizontal bands 54, but terminate short of the edges of the lumbar section 44 to define vertical side edge bands 55 (FIG. 3). The horizontal and vertical bands 54 and 55 are semi-flexible and designed to be sufficient in size and strength to provide the support desired. Due to the locations of top and bottom pivot locations 44 and 45 and also due to the shape and characteristics of the sections 41–43 and belt bracket 46, the back support shell 27 flexes significantly in the lumbar area, but rotates along a predetermined path a substantial amount around the bottom pivot location 45 and to a lesser extent around the top pivot location 44. This results is significant wrinkling of the upholstery material, unless the back construction 24 is constructed to compensate and make up for this high flexure, and the high compressing and stretching of the surfaces (i.e., the upholstery) in the lumbar section 44.

Figure 6:
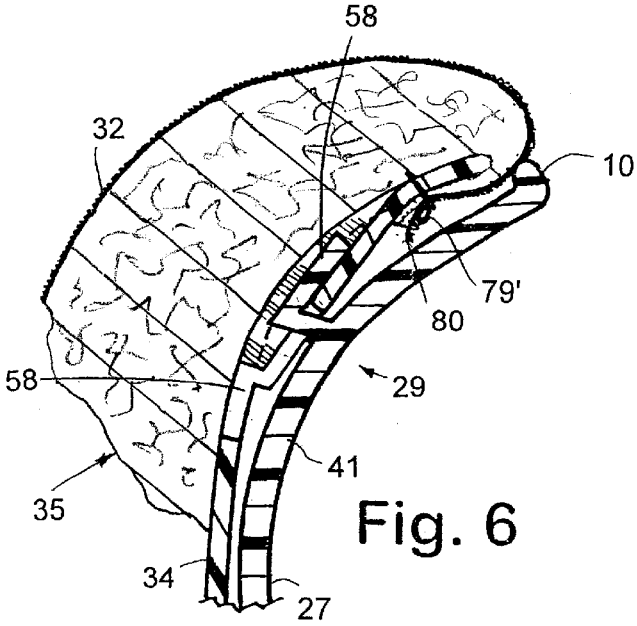
FIG. 5 and 6 are enlarged views of the circled areas V and VI in FIG. 4.

The thoracic section 41 (FIG. 6) includes a ridge 57 along its upper edge and a series of hooks 58 spaced below the ridge 57 that project forwardly and then upwardly. A pair of apertures 59 is spaced below the hooks 58. The apertures 59 are positioned to receive screws 60 (FIG. 4) that extend rearwardly through the apertures 59 into threaded engagement with bosses 61 near a top of the arch-shaped back frame 22. The apertures 59 are recessed to create a rearwardly deformed pocket to receive a head of the screws 60 as desired. A pair of alignment stops 62' is located in the recesses on a front of the back support shell 27 adjacent apertures 59 to assist in assembly, as described below.

A pair of saw-tooth ridges 63 (FIG. 3) extends along a front face of the vertical bands 55 at a location near to but spaced inwardly from outer edges of the bands 55. A lumbar adjustment device 65 is positioned between the cushion assembly 28 and the back support shell 27. The lumbar adjustment device 65 includes a carrier 66, a lumbar support member 67 with vertical leaf-spring-like fingers 68 supported on the carrier 66, and a pair of side handles 69. The side handles 69 telescopingly engage mating structures 70 on ends of the carrier 66, and further include a channel for slidably engaging the saw-tooth ridges 63. A detent on the handles 69 engages the saw-tooth ridges 63 to hold the lumbar adjustment device in a selected vertical position.

Figure 7:
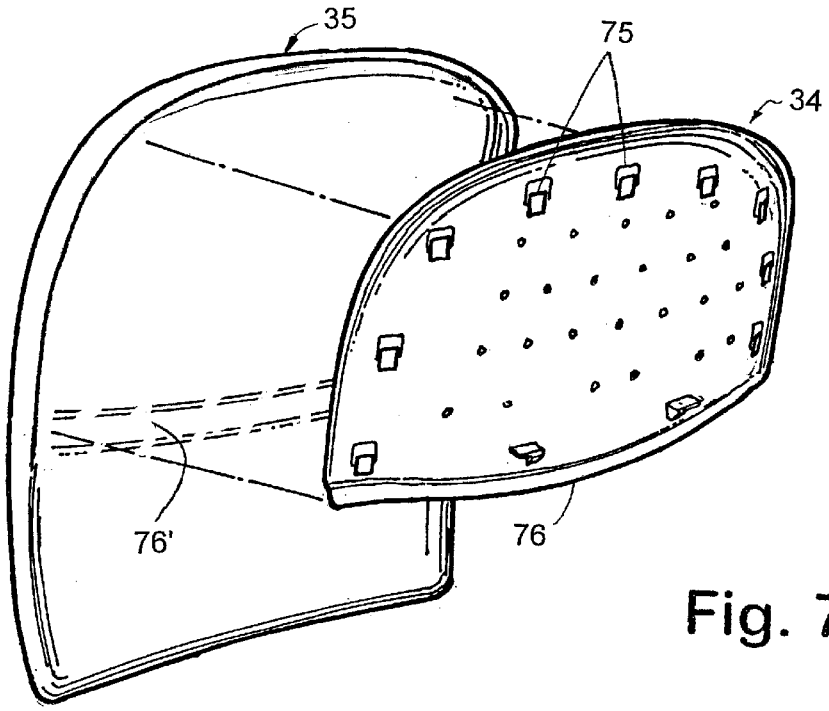
FIG. 7 is an exploded perspective view of the stiffened cushion subassembly shown in FIG. 3.

The cushion assembly 28 includes a back cushion 35 (FIG. 3) formed of non-woven PET fibers, as described below. The back cushion 35 provides an excellent initial support and feel to a seated user when he/she initially leans against the cushion assembly 28, even without use of a topper sheet commonly used in the seating industry. The cushion stiffener 34 comprises a stiff polypropylene panel. The cushion 35 includes a rear surface shaped to mateably receive the cushion stiffener 34. An upper edge 74 (FIG. 7) on a rear surface of the cushion 35 is wrapped over the upper edge 74 and onto a rear surface of the cushion stiffener 34. The cushion stiffener 34 is adhered to the cushion 35 if needed to maintain the stability of the assembly desired. The cushion stiffener 34 includes a series of spaced-apart apertures 75 that correspond to the hooks 58 (FIG. 3). A horizontal down flange 76 (FIG. 7) extends along a lower edge of the cushion stiffener 34, which flange 76 is deformed inwardly toward the cushion 35 at least a thickness of the material of rear panel 33, so that the rear panel 33 does not protrude outwardly when attached to the flange 76, as described below. The cushion 35 has a recess 76' that mateably engages the flange 76.

Figure 5:
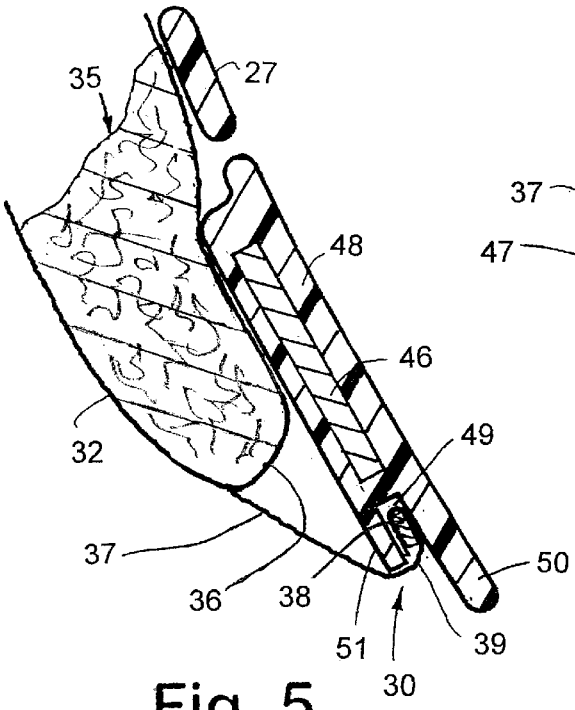

As noted above, the cover assembly 31 (FIG. 8) includes a front panel 32 and a rear panel 33. The front panel 32 includes sections of upholstery material sewn together to form the front and sides of a covering for the cushion 35. The rear panel 33 includes the first fabric section 36, which comprises a material that stretches horizontally only about five percent (5%), but that stretches vertically about forty percent (40%). The one-directional stretch material is available in commerce, such as from Milliken Company, Spartanburg, S.C. This first fabric section 36 is sized to extend from the mid-level horizontal flange 76 on the cushion stiffener 34 downwardly to a bottom of the cushion 35. The second section 37 is a high-stretch material having a stretchability of about one hundred percent (100%). This second section 37 is about two-inches high and extends across a bottom of the rear panel 33 of the cover assembly 31. A strip of stiffener material 78, such as polypropylene, is about ¼-inch wide in a vertical direction and is placed along a lower edge of the second section 37. The lower edge is folded over the strip 78 and sewn to the lower edge. This forms a stiffened edge flange 79 horizontally across the second section 37 that is optimally suited to be pressed or "zipped" into and frictionally retained in the horizontal recess 49 with a zip-lock like motion (see FIG. 5). Notably, the stiffened edge flange 79 is rectangular in shape and is rolled forwardly 180 degrees before it is inserted into the recess 49 (FIG. 5). This results in a surprisingly positive and secure bottom connection arrangement and one that can be quickly made by an assembler. The top rear edge of the front panel 32 (FIG. 6) is folded and sewn to form a tunnel 79', and a drawstring 80 is located in the tunnel. The front and rear panels 32 and 33 are sewn together to form an upwardly open sock. The panels 32 and 33 are initially sewn in an inverted position, and the cushion 35 is inserted into the sock as the sock in inverted. This also hides the seam lines where the panel 32 and first and second fabric sections 36 and 37 are sewn together.

Figure 9:
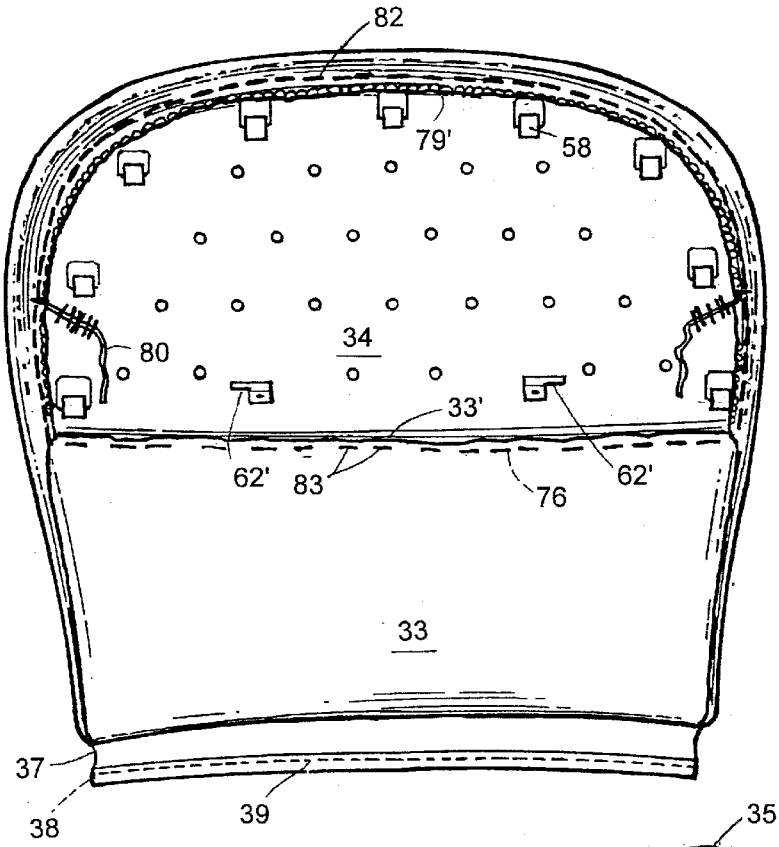
FIG. 9 is a rear view of the cushion assembly shown in FIG. 3, including the stiffened cushion subassembly and the cover assembly.
Figure 10:
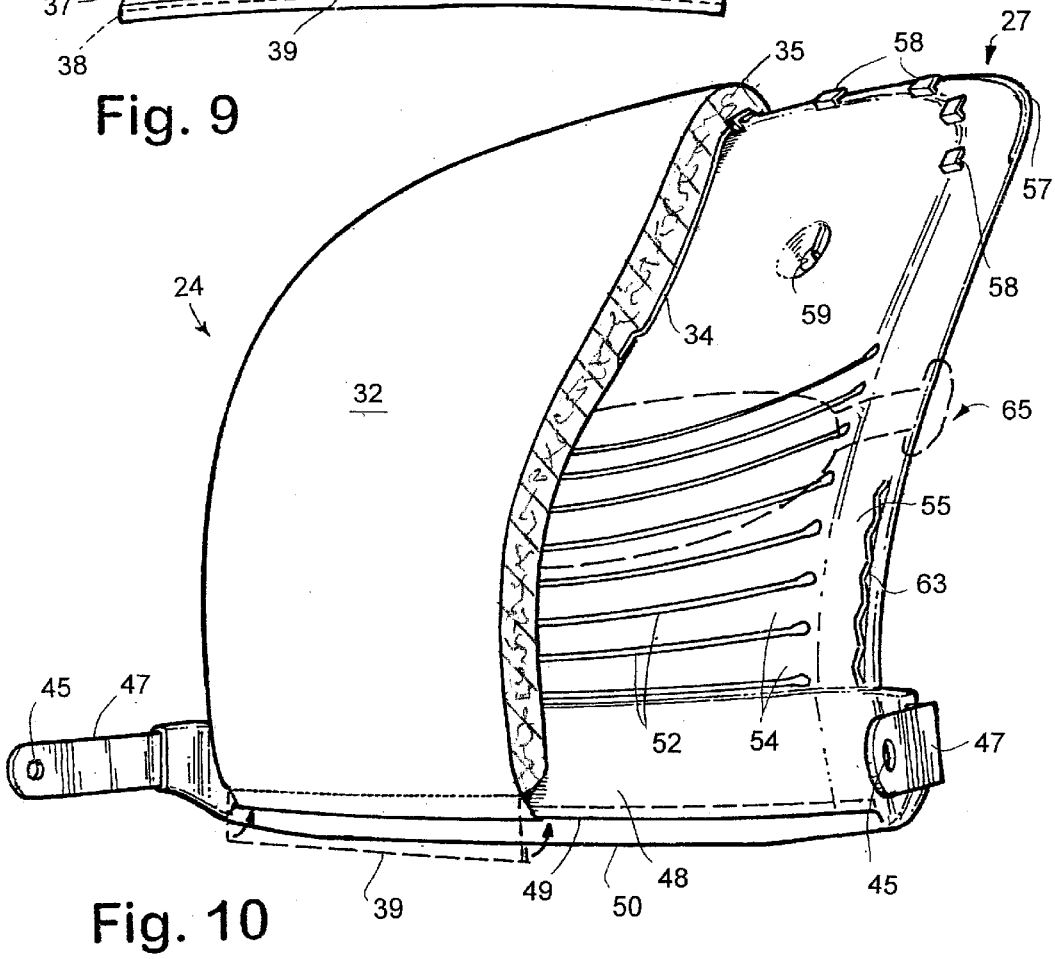
FIG. 10 is a front perspective view, partially broken away, showing the back construction of FIG. 3.
Figure 13:
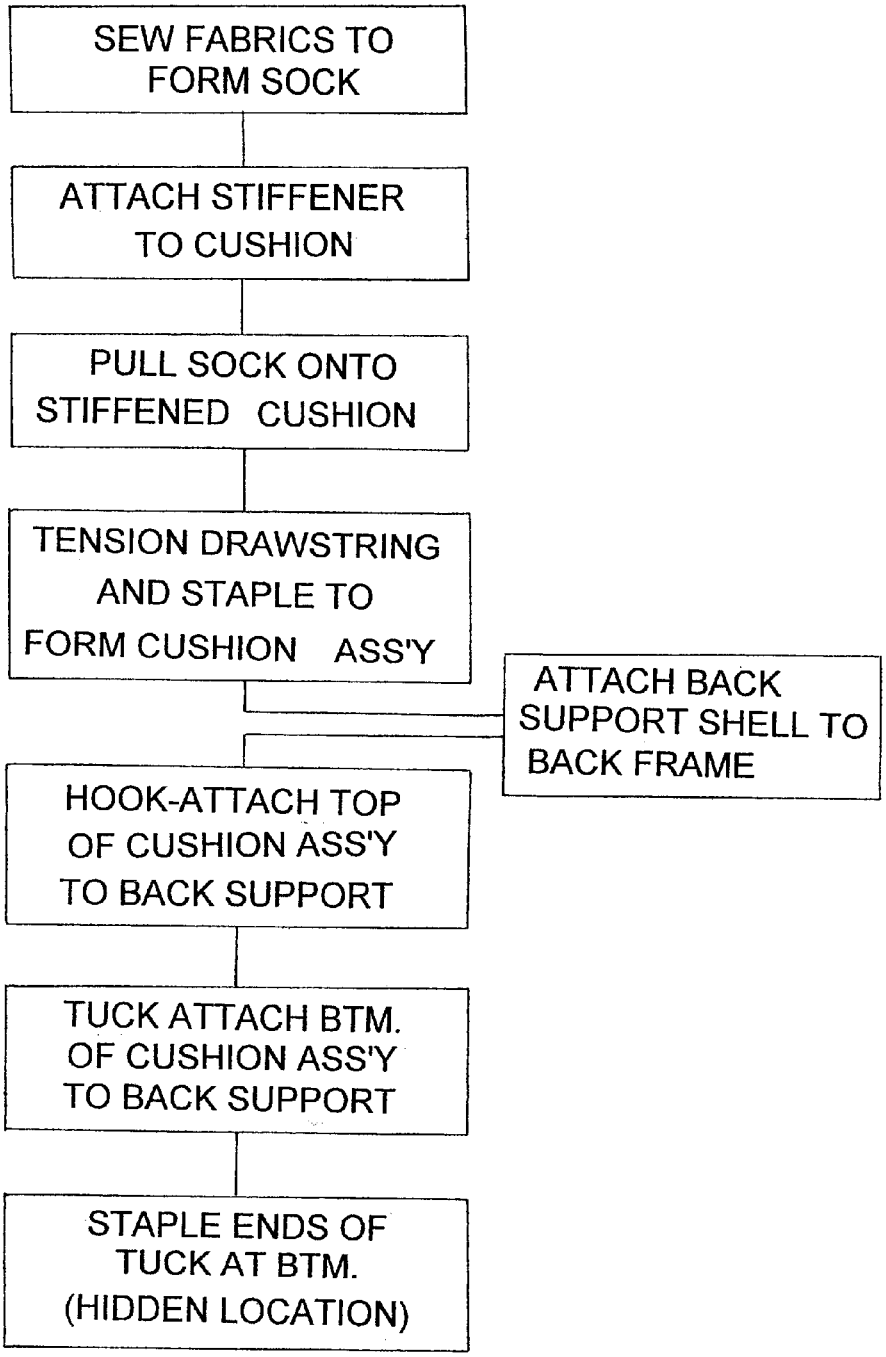
FIG. 13 is a flow diagram showing a method of assembly.

FIG. 13 discloses a method including forming a sock-like cover assembly 31 in a step 90 from the panels 32 and 33 and second fabric section 37. Step 90 further includes sewing a strip 78 to a bottom of second fabric section 37 and attaching a drawstring 80 in a tunnel 79'. A second step 91 includes attaching cushion stiffener 34 to the cushion 35. The cover assembly 31 is positioned adjacent the cushion 35 and inverted onto an end of the cushion 35 opposite the cushion stiffener 34 in a step 92. This results in the high-stretch second fabric section 37 being positioned at a lower edge of the cover assembly 31 remote from the cushion stiffener 34. The cover assembly 31 is then adjusted on the cushion 35 and cushion stiffener 34 to eliminate wrinkles and to properly position the seam lines. This may include tensioning the drawstring 80, as shown in step 93. Specifically, in the illustrated embodiment, the drawstring 80 is tensioned to draw a top of the cover assembly 31 downwardly onto the cushion stiffener 34. This also tensions the front panel 32. The tensioned drawstring 80 helps hold the cover assembly 31 in position during the steps of inserting staples 82 and 83, and during a step of setting any adhesive in the assembly. The front panel 32 is then staple-attached along its upper edge to the cushion stiffener 34 by staples 82 (FIG. 9) that extend through the wrapped-over top edge of the front panel 32 into the cushion stiffener 34. The upper edge 33' of the rear panel 33 is overlapped onto the down flange 76 and is stapled with staples 83 that extend through the upper edge into the down flange 76. Where desired, heat-activated adhesive is applied to a front surface of the cushion 35, and the adhesive is activated by steam or heat to adhere the front panel 32 to the cushion 35. This assembly results in cushion assembly 28.

The back support shell 27 of the back construction 24 (FIG. 13) is attached in a step 94 to the back frame 22 by screws at the top connection 44 and by pivot studs at the bottom connection 45. A lumbar force adjusting device 95 (FIG. 1) is attached to the back frame 22 to bias the flange 47 of belt bracket 46, such that the lumbar section 43 of the back support shell 27 naturally is biased to a forwardly concave shape.

The cushion assembly 28 is assembled onto the back support shell 27 in a step 96 (FIG. 13) to form the back construction 24 by abutting stops 62' on the cushion stiffener 34 against the stops 62' on the back support shell 27, and by extending the hooks 58 on the thoracic section 41 of the back support shell 27 into the apertures 75 of the cushion stiffener 34. Then, the back cushion 35 including the cushion stiffener 34 is moved downwardly to frictionally engage the hooks 58. Thereafter, the stiffened edge flange 39 at the bottom of the rear panel 33 is stretched, rolled 180 degrees, and tucked upwardly into the downwardly facing horizontal recess 49 on the back support shell 27 (in a step 97). The stiffened edge flange 39 is tucked into position from one side to another with a zip-lock type motion. After it is fully inserted, the side edges of the high-stretch second section 37 are pulled back, and a staple is extended through the stiffened edge flange 39 into each end of the rear lip 50 in a step 98. The high-stretch second section 37 is then pulled laterally out to a wrinkle-free condition where it hides these end-located staples. Notably, the high-stretch second section 37 is a dark or black color and is located behind the seat 23 below the back construction 24 in the shadow of the back construction 24, such that the bottom connection 30 including the enlarged section 48 of the back support shell 27 is not easily visible to a person standing in or around the chair 20.

Figure 11:
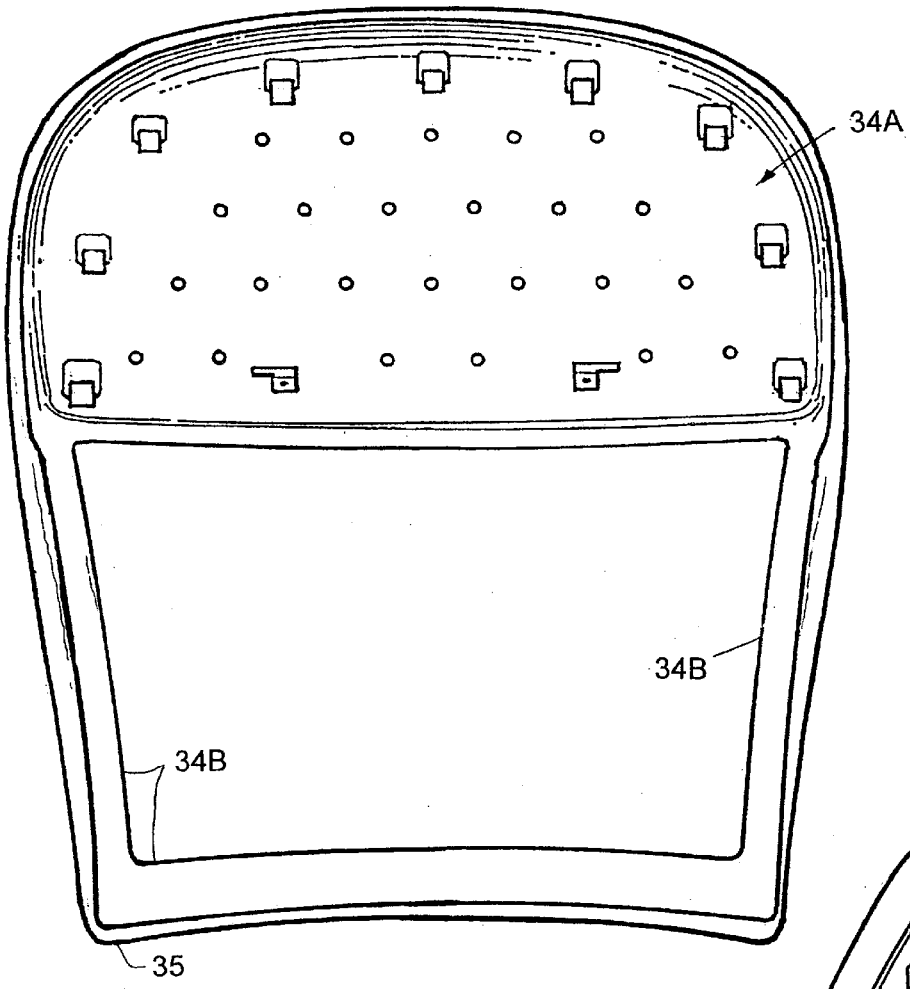
FIG. 11 is a rear view of a modified cushion assembly similar to that shown in FIG. 9, but with edge stiffener legs extending downwardly along side edges of the cushion pad.
Figure 12:
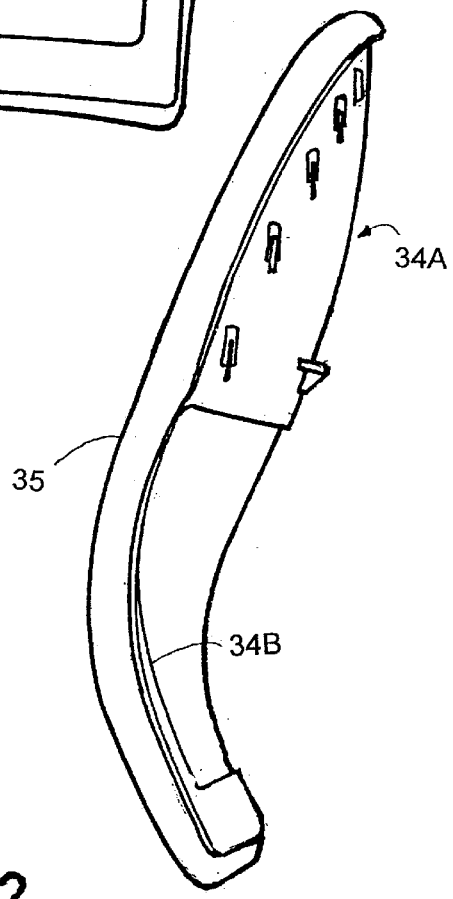
FIG. 12 is a side view of the modified cushion assembly shown in FIG. 11.

In the embodiment of FIGS. 11 and 12, a modified cushion stiffener 34A is provided that includes an upper portion like the stiffener 34, but further includes perimeter bands 34B that extend down side edges and along a bottom of the cushion 35 to stiffen the edges completely around the cushion 35. Cushion stiffener 34A is desirable where the fabric panels 32 or 33 are so strong as to overpower the cushion edges causing wrinkling.

As noted above, the cushion 35 is made from a recycled non-woven PET fibrous mat supplied by Sackner Co., Grand Rapids, Mich. The PET mat is molded to form a novel cushion that is substituted for the polyurethane cushion and the topper cushion often used in prior art. Non-woven polyester or PET is a polyester with a phenylene group in a chain. The stiffness of this chain is what allows the thermoplastic to perform surprisingly and unexpectedly well as a cushioning fiber, as discussed below.

When PET completely burns, it turns into carbon dioxide and water and does not emit any poisonous gases. Food products can be packaged in this material without any worry, and containers can be burned without the need for extraordinary emission control measures. This is not true for polyurethane, which will emit dangerous byproducts when burned. Use of PET material is also environmentally friendly. A major source of the PET material for cushion 35 comes from reground pop bottles. Recycling of PET pop bottles into headliner cores, insulation, and door panels has apparently been previously done. However, its use as a complete cushion for a chair seat or chair back has not been done to my, the inventor's, knowledge.

Figure 14:
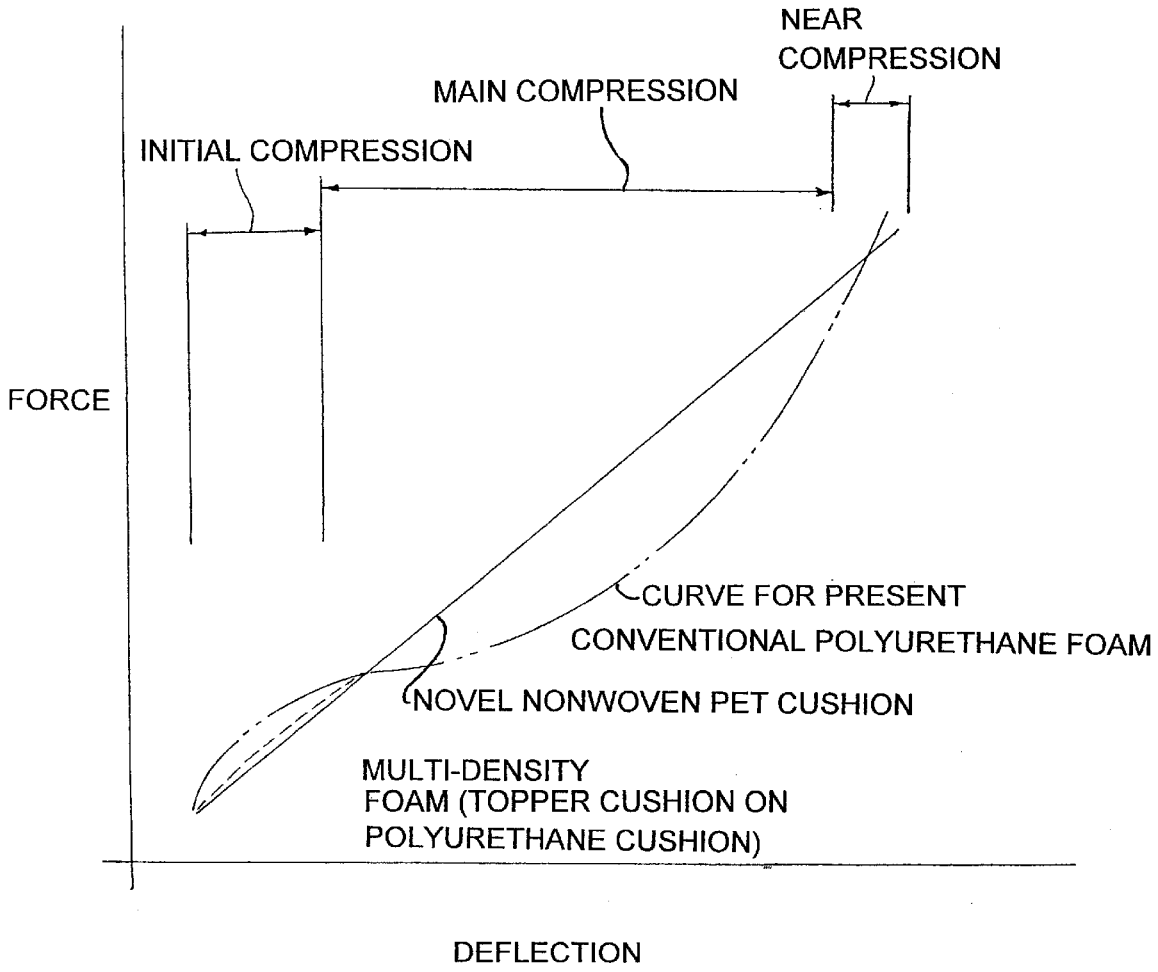
FIG. 14 is a force versus deflection curve comparing the novel cushion of non-woven PET fibers to a conventional polyurethane foam cushion.

A major advantage of the PET cushion material are that it is 15 to 20 percent lighter than polyurethane foam, yet it provides a high value and high value per unit cost. Further, the PET cushion material provides improved comfort to a seated user including a very uniform force versus deflection curve (see FIG. 14) with a surprisingly constant slope over a major portion of its compression. The more conventional polyurethane foam has a much less constant rate of compression. Often a topper cushion (e.g., about a ¼-inch thick cushion) is placed on a main cushion (e.g., about a 1-inch thick cushion) to "smooth out" the initial compression of the main cushion. However, this adds considerable expense. The non-woven fibrous cushion 35 does not need any such topper cushion. Further, the PET cushion material provides more breathability including the ability to wick away a seated user's sweat, provides excellent fatigue resistance and long life with little or no generation of dust after extended time in service, provides a capability of easy and low cost recycling, and has no carcinogens or VOC's in its manufacture. Further, my initial research indicates that replacing molded foam with an equivalent piece of PET cushion results in a break-even or a decrease in costs.

Thermal comfort studies done by or for Steelcase, the assignee of the present invention, indicate a 50 percent higher/greater moisture permeability index in the supplied PET cushion than molded urethane foam cushions. This is believed to be due to the more open internal (fibrous) structure of the PET material. Higher index numbers equate to more desirable comfort. Also, the evaporative resistance of the PET cushion is less than half that of the molded foam cushion. The lower evaporative resistance correlates to improved comfort also in that the moisture given off by the body is absorbed and dispersed through the PET cushion much faster than through the molded urethane cushion.

Testing of the PET and molded urethane foam, using tests known to persons skilled in making chairs, indicates a lower initial load deflection characteristic of the PET cushions over the more traditional urethane foams, but a higher support factor, better ball rebound, better tensile strength and elongation, and a more linear cushioning rate. Tests suggest the feel to be more "residential" verses "industrial" (see FIG. 14).

Advantageously, the non-woven PET cushion can be formed into a three-dimensional shape to conform properly to a particular chair geometry. Leaving the material in a flat shape and attaching it to the chair can result in a "kinking" of the PET material in some highly contoured chair designs, which may telegraph a crease or wrinkle into the face fabric of these chairs.

My proposed system works as follows. For the seat 23 of chair 20, batting of material is optimally produced to a known raw mat density and thickness, such as about 2.3 to 2.6 lb./ft$^3$, with a thickness of about 2 inches (unformed) or about 2.3 to 3.5 lb./ft$^3$ density (or more preferably between about 3.1 to 3.5 lb./ft$^3$) with a thickness of about 1½ inches (formed). A similar density of about 2.3 to 2.6 lb./ft$^3$ is used for back cushion 35, but the thickness is different. For example, in cushion 35 the thickness is about 1 inch (unformed) or about 2.3 to 5.2 lb./ft$^3$ density (or more preferably between about 4.6 to 5.2 lb./ft$^3$) with a thickness of about ½ inch (formed). The material is cut to a predetermined size with a die cut, laser cut, or any other efficient means of trim. This preform is then loaded into a three-dimensional aluminum tool cavity of the desired shape. The cavity and lid are both predrilled to allow steam to pass through the tool halves. The material is then introduced to about a 30 second (plus or minus 5 to 10 seconds) steam heating cycle of about 250 degrees Fahrenheit that breaks the temporary thermal adhesive bond, and a 10 second (plus or minus 5 seconds) cooling cycle of ambient air that allows the material to rebond in the desired three-dimensional shape. The memory of the material is thus changed to the new shape and the part is removed from the tool. Since no edge trimming is required, edges can be produced round, and since the edges are not trimmed, edges do not have a hard edge or look non-uniform. Less handling and sensitive trimming also result in reduced costs of manufacture. Also, there is no scrap in terms of flashing or trimmings from the forming process, and any scrap, if generated, can be recycled.

The compressibility and shape of the cushion is also more uniform, since a uniformly produced batting of material, cut to a controlled size, was loaded into the tool and no materials were discarded in the forming process. Feature lines, depressions, and the like can be molded or pressed into the cushion material. Characteristically, no flash lines or parting lines are formed, such that the marginal material around a perimeter of the part feels the same as (and has the same density and compressibility as) the main part of the cushion.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A seating unit comprising:

a base;

a seat support supported by the base;

a back upright operably supported on the base for movement between an upright position and a reclined position;

a back construction including a back support attached to the back upright; and a cushion supported by a surface on one of the back support and the seat support, the cushion comprising a non-woven fibrous mat of material that is air-permeable and that has a horizontal feature line formed into the cushion, and including a stiffener attached to the cushion.

2. A seating unit comprising:

a base;

a back upright operably supported on the base for movement between an upright position and a reclined position; and a back construction including a back support attached to the back upright, and further including a cushion supported by a front surface of the back support, the cushion comprising a non-woven fibrous mat of material that is air-permeable and including a stiffener attached to the cushion, the support including a lumbar section that is flexible and that forms a part of the back, the lumbar section including horizontal slits that permit air to pass from the cushion through the support to ambient air.

3. The seating unit defined in claim 2, wherein the lumbar section includes leaf-spring-simulating horizontal bands separated by the slits, and further includes leaf-spring-simulating vertical bands supporting ends of the horizontal bands.

4. The seating unit defined in claim 3, wherein the support panel includes a stiff thoracic section and a stiff pelvic section connected to the stiff thoracic section by the lumbar section.

5. The seating unit defined in claim 2, wherein the support comprises a polymeric sheet-shaped shell.

6. The seating unit defined in claim 2, wherein the cushion is made entirely from PET material.

7. The seating unit defined in claim 2, wherein the cushion has a density of about 2.3 to 5.2 lb./ft$^3$.

8. The seating unit defined in claim 2, wherein the cushion includes opposing side edges and the non-woven fibrous mat comprises a continuous one-piece mat of intertwined fibers between the opposing side edges.

9. The seating unit defined in claim 2, wherein the cushion characteristically has a very uniform and linear force versus deflection curve over its compression cycle when a user rests against the cushion.

10. A seating unit comprising:

a base;

a back upright operably supported on the base for movement between an upright position and a reclined position; and a back construction including a back support attached to the back upright, and further including a cushion supported by a front surface of the back support, the cushion comprising a non-woven fibrous mat of material that is air-permeable, and a stiffener attached to the cushion.

11. The seating unit defined in claim 10, wherein the stiffener includes connectors for attachment to the support.

12. The seating unit defined in claim 10, wherein the cushion includes PET material.

13. The seating unit defined in claim 10, wherein the cushion includes edges having a density of about 2.3 to 5.2 lb./ft$^3$.

14. The seating unit defined in claim 13, wherein the cushion has a density of about 3.1 to 3.5 lb./ft$^3$.

15. The seating unit defined in claim 10, wherein the support includes a panel with apertures permitting air to flow from the cushion through the [support] panel into ambient air.

16. The seating unit defined in claim 10, wherein the support includes a panel with a lumbar section that is flexible and that forms a part of the back.

17. A seating unit comprising:

a base;

a back upright operably supported on the base for movement between an upright position and a reclined position; and a back construction including a back support attached to the back upright, and further including a cushion supported by a front surface of the back support, the cushion comprising a non-woven fibrous mat of material that is air-permeable and that has a density of about 2.3 to 5.2 lb./ft$^3$ with edges of the cushion having a density similar to a remainder of the cushion, and wherein the edges characteristically do not include a parting line nor flash line of rigid dense material that extends around a perimeter of the cushion and further including a stiffener attached to the cushion.

18. A seating unit comprising:

a base;

a back upright operably supported on the base for movement between an upright position and a reclined position;

a back construction including a back support attached to the back upright, and further including a cushion supported by a front surface of the back support, the cushion comprising a non-woven fibrous mat of material that is air-permeable; and a feature line formed into the cushion and including a stiffener attached to the cushion.

19. The seating unit defined in claim 18, wherein the feature line comprises a horizontally extending recess formed across the cushion.

20. A seating unit comprising:

a base;

a back upright operably supported on the base for movement between an upright position and a reclined position; and a back construction including a back support attached to the back upright, and further including a cushion assembly supported by a front surface of the back support, the cushion comprising a non-woven fibrous mat of material that is air-permeable, the cushion having a perimeter and having marginal material extending around the perimeter that is characteristically free from rigid parting lines and free from other dense material that is noticeably higher in density than a remainder of the cushion, and including a stiffener attached to the cushion.

21. The seating unit defined in claim 20, wherein more than half of the cushion is made from reground beverage bottles.

22. The seating unit defined in claim in, including a seat and wherein the seat and the back both include cushions made from the non-woven fibrous mat.

23. A seating unit component manufactured for use in a seating unit, comprising:

a flexible support panel having a support surface shaped to support a seated user; and a cushion made from a one-piece non-woven fibrous mat of polymeric PET fibers covering the support surface of the support panel, the support panel including horizontal slits in a flexible region and the cushion being air permeable for allowing airflow from the cushion through the slits in the support panel to ambient air, and including a stiffener attached to the cushion.

* * * * *